United States Patent [19]

Inoue et al.

[11] Patent Number: 4,825,753

[45] Date of Patent: May 2, 1989

[54] CAM PLATE TYPE AXIAL PISTON PUMP

[75] Inventors: Kiyoshi Inoue, Kawasaki; Masakazu Nakazato, Sagamihara, both of Japan

[73] Assignee: Kayaba Industry Co., Ltd., Japan

[21] Appl. No.: 138,213

[22] Filed: Dec. 28, 1987

[51] Int. Cl.[4] ..... F01B 3/00; F01B 13/04

[52] U.S. Cl. ..... 92/12.2; 91/505; 74/60; 74/839

[58] Field of Search ..... 92/12.2, 13; 91/504, 91/505, 506; 417/222; 74/60, 839

[56] References Cited

U.S. PATENT DOCUMENTS

| | | | |
|---|---|---|---|
| 2,475,295 | 7/1949 | Sherman | 74/60 |
| 2,917,931 | 12/1959 | Sherman | 92/12.2 |
| 3,006,324 | 10/1961 | Shaw | 74/60 |
| 3,246,577 | 4/1966 | MacIntosh | 74/60 |
| 3,359,810 | 12/1967 | Hansen | 74/60 |
| 3,935,796 | 2/1976 | Wood | 91/504 |
| 3,973,471 | 8/1976 | Hirmann | 92/12.2 |
| 4,584,926 | 4/1986 | Beck, Jr. et al. | 92/12.2 |

FOREIGN PATENT DOCUMENTS

| | | | |
|---|---|---|---|
| 0042632 | 4/1929 | Denmark | 91/504 |
| 0526238 | 6/1931 | Fed. Rep. of Germany | 92/12.2 |
| 1063853 | 8/1959 | Fed. Rep. of Germany | 92/12.2 |
| 1357561 | 2/1964 | France | 91/505 |

*Primary Examiner*—Robert E. Garrett
*Assistant Examiner*—Thomas Denion
*Attorney, Agent, or Firm*—Steinberg & Raskin

[57] ABSTRACT

A cam plate type axial piston pump capable of operating a control lever operatively connected to a cam plate to control an inclination angle of the cam plate and control its discharge depending on the inclination angle. A piston pump of such type exhibits self-return force toward a position nearer its neutral point when it reaches a position near the neutral point. The pump of the present invention is so constructed that a thrust plate provided on a cam plate is pivotally moved in order to positively utilize the self-return force.

28 Claims, 9 Drawing Sheets

CAM PLATE TYPE AXIAL PISTON PUMP

BACKGROUND OF THE INVENTION

This invention relates to a cam plate type axial piston pump adapted to control an inclination rotation angle of a cam plate to control discharge from the pump, and more particularly to a cam plate type axial piston pump which is optimum for use for a hydrostatic power transmission.

A conventional cam plate type axial piston pump of such type is typically constructed in such a manner that when it is used for a hydrostatic power transmission, control of its forward movement, backward movement and stoppage is generally carried out by varying an inclination angle of a cam plate of the pump. More particularly, the cam plate type axial piston pump is adapted to exhibit its stoppage function when a control lever is held at a neutral position to keep an inclination angle of the cam plate zero, and its forward movement or backward movement function is carried out by inclining the cam plate from the zero degree position in a desired direction. This results in movement or stoppage of a driven unit such as a vehicle or the like taking place through the hydrostatic power transmission. Thus, the conventional cam plate type axial piston pump fails to exhibit its satisfactory stoppage function, unless an inclination angle of the cam plate is positively rendered zero when the control lever is held at the neutral position.

Unfortunately, when the control lever is provided with only one stop point or position for the purpose of stoppage of the driven unit, any external force such as mechanical vibration or the like which is applied to the control lever causes the stop point to deviate. In particular, this causes insufficient operation, for example, by an unskilled operator, to fail to positively set the control lever at the stop point, resulting in safety of the driven unit being highly deteriorated.

In view of the foregoing, a cam plate type axial piston pump was proposed which is provided with a mechanism connected to the driven unit and adapted to exhibit unsteadiness when a control lever is positioned adjacent to its neutral position.

In general, it is known that a cam plate type axial piston pump, when it reaches a position near its neutral point, exhibits self-return function which causes it to further return to the neutral point. The proposed cam plate type axial piston pump, as described above, is so constructed that the connection mechanism may exhibit unsteadiness when the control lever is positioned adjacent to the neutral position.

Neutral characteristics of the proposed cam plate type axial piston pump constructed as described above depend on unsteadiness of the pump and unsteadiness is varied depending on the individual piston pump. Accordingly, neutral point return characteristics of the pump are varied on the individual piston pump.

Further, the proposed pump has another disadvantage that the control lever and/or a cam plate are apt to vibrate due to wear or deformation of the connection mechanism, resulting in a variation of its neutral point return characteristics. The neutral point return characteristics are also varied due to a failure in control of an inclination angle of the cam plate with high accuracy.

SUMMARY OF THE INVENTION

The present invention has been made in view of the foregoing disadvantage of the prior art.

Accordingly, it is an object of the present invention to provide a cam plate type axial piston pump which is highly improved in neutral point return characteristics.

It is another object of the present invention to provide a cam plate type axial piston pump which is capable of exhibiting self-return force or function near its neutral point to improve its neutral point return characteristics.

In accordance with the present invention, a cam plate type axial piston pump is provided. The pump includes a cam plate of which an inclination angle is controlled to control discharge of the pump and a piston provided at a tip end thereof with a shoe. Opposite to the cam plate is arranged a thrust plate which slidingly contacts the shoe of the piston. The thrust plate is pivotally moved in any direction with respect to the cam plate.

Accordingly, the pump of the present invention permits an inclination angle of the cam plate to be increased to increase neutral point return moment when a control lever is positioned near its neutral point. This results in an inclination angle of a contact surface of the shoe relative to a cylinder block being readily kept zero to increase a neutral width which indicates a range of non-discharge of the pump.

A range of generation of the return moment and a range of the non-discharge are varied by adjusting a range of pivotal movement of the thrust plate interposed between the cam plate and the shoe.

Thus, the present invention allows a range of generation of the return moment and a range of the non-discharge to be relatively readily or freely set. Accordingly, it readily exhibits desired return characteristics with respect to operation of the control lever, to thereby obtain satisfactory neutral characteristics. This causes the pump of the present invention to be hard to be adversely affected due to vibration of a driven unit or the like and permits discharge of the pump to be positively rendered zero for the purpose of stoppage of the driven unit irrespective of skill of an operator.

In addition, when a detent mechanism is employed for keeping a neutral position of the pump, it is not required to exhibit good accuracy in keeping the neutral position. Accordingly, zero adjustment of the mechanism may be highly readily accomplished.

Furthermore, the thrust plate is arranged in a hydraulic fluid environment in a pump casing, so that it may exhibit a damping effect to not only drastically decrease vibration of the cam plate and control lever but substantially eliminate adverse affection of its wear or deformation on control of an inclination angle of the cam plate.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Now, a cam plate type axial piston pump according to the present invention will be described hereinafter with reference to the accompanying drawings.

Figure 1:
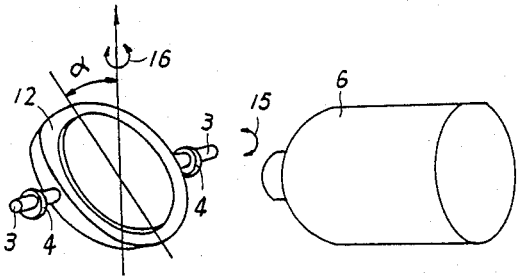
FIG. 1 is a schematic perspective view showing a relative relationship between a cam plate and a cylinder block in a cam plate type axial piston pump according to the present invention.

FIG. 1 shows relative relationships between a cam plate and a cylinder block in the present invention, which are designated by reference numerals 12 and 6 in FIG. 1, respectively. The cam plate 12 is provided at both ends thereof with a pair of trunnion pins 3, which are adapted to be supported in bearings 4. The cam plate 12 is adapted to be pivotally moved about the trunnion pins 3 in directions indicated at arrows 15 to adjust an inclination angle (alpha). The arrows 15 indicate directions of inclination of the cam plate 12. Directions indicated at arrows 16 are substantially perpendicular to the directions 15.

Figure 2:
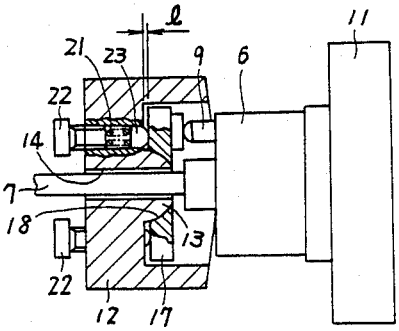
FIG. 2 is a front elevation view partly in section illustrating a first embodiment of a cam plate type axial piston pump according to the present invention.
Figure 3:
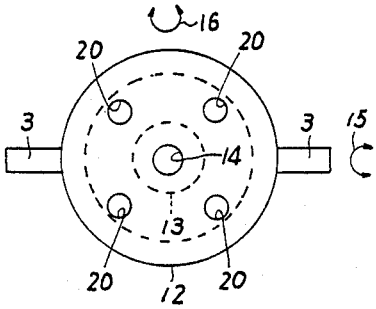
FIG. 3 is a side elevation view showing a cam plate incorporated in the embodiment of FIG. 2.

FIGS. 2 and 3 show a first embodiment of a cam plate type axial piston pump according to the present invention. A piston pump of the illustrated embodiment includes a cylinder block 6 having an input shaft 7 forwardly extending from a front surface thereof, a cam plate 12 formed with a through-hole 14, and a thrust plate 17. In the illustrated embodiment, the through-hole 14 is formed to extend along a central axis of the cam plate 12. The input shaft 7 of the cylinder block 6 is inserted via the thrust plate 17 and the through-hole 14 of the cam plate 12 to forwardly project from the cam plate 12. The cam plate is formed at a central portion of an inner surface thereof with a projection 13 of a substantially semi-spherical shape, through which, in the illustrated embodiment, the input shaft 7 extends.

The thrust plate 17 is provided at a central portion of a surface thereof opposite to the cam plate 12 with a recess 18 of a shape corresponding to the projection 13 of the cam plate 12 and fitted through the recess 18 on the projection 13 so as to be opposite to and concentric with the cam plate 12.

The cam plate 12 and thrust plate 17 fitted at the recess 18 on the projection 13 of the cam plate 12 are arranged so as to define a gap of a distance l therebetween when they are vertically positioned as shown in FIG. 2, so that the thrust plate 17 may be pivotally moved in any direction with respect to the cam plate 12 within a range of the gap l.

Also, the piston pump of the illustrated embodiment is so constructed that elastic force acts on the surface of the thrust plate 17 opposite to the cam plate 12 to space the thrust plate 17 from cam plate 12. For this purpose, a plurality of springs 21 are arranged in through-holes 20 axially formed at the cam plate 12 so that elastic force of the springs 21 may acts on the surface of the thrust plate 17 through forcing pistons 23 likewise arranged in the through-holes 20. Such construction ensures positioning characteristics of the thrust plate 17 or that the thrust plate 17 is kept at a fixed position with respect to the cam plate 12.

Elastic force generated from each of the springs 21 may be adjusted by means of an adjustment screw 22 which acts to variably adjust a length of the spring 21, as desired.

The thrust plate 17, as described above, is arranged so as to be pivotally movable in any direction. Accordingly, in the illustrated embodiment, elimination of the springs 21, adjustment screws 22 and pistons 23 does not substantially affect function of the thrust plate 17.

The projection 13 of course is not limited to have a specific size or diameter. However, in the illustrated embodiment, the input shaft 7 is passed through the projection 13, accordingly, it is formed to have a diameter larger than that of the input shaft 17.

Alternatively, the first embodiment may be constructed in such a manner that the projection 13 is formed at the thrust plate 17 and the recess 18 may be formed at the cam plate 12.

In the first embodiment constructed as described above, when a control lever (not shown) is positioned near its neutral position, self-return force is generated in the piston pump to cause a neutral position return moment to be generated, so that the thrust plate 17 may be pivotally moved within a range of the gap l to keep a relative inclination angle between a sliding surface of the thrust plate 17 and the cylinder block 6 zero.

At this time, when an axis about which the thrust plate 17 is pivotally moved is defined near a line defined by connecting the trunnion pins 3 and 3 together, a neutral width of the thrust plate 17 tends to be increased. Whereas, when the axis is defined so as to be substantially perpendicular to the line, self-return force of the thrust plate 17 tends to be increased.

Accordingly, arrangement of the thrust plate 17 which permits it to be pivotally moved in any direction as in the illustrated embodiment causes the axis about which the thrust plate 17 is pivotally moved with respect to the trunnion pins 3 to be automatically set at an optimum angle depending on characteristics of the cam plate type axial piston pump.

Thus, it will be noted that the piston pump of the illustrated embodiment exhibits satisfactory neutral characteristics because it effectively carries out self-control so that the axis of pivotal movement of the thrust plate 17 keeps self-return moment and neutral width of the thrust plate 17 at an optimum state depending on the characteristics of the pump.

Figure 4:
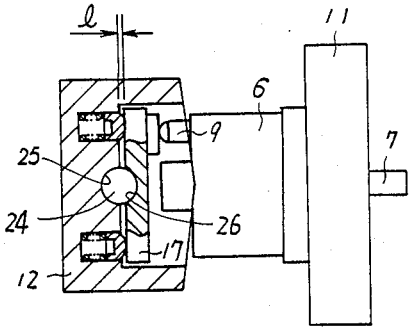
FIG. 4 is a front elevation view partly in section illustrating a second embodiment of a cam plate type axial piston pump according to the present invention.
Figure 5:
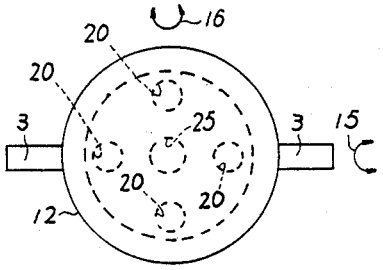
FIG. 5 is a side elevation view showing a cam plate incorporated in the embodiment of FIG. 4.

FIGS. 4 and 5 show a second embodiment of a cam plate type axial piston pump according to the present invention. In a piston pump of the second embodiment, a cam plate 12 and a thrust plate 17 are formed at portions thereof opposite to each other with recesses 25 and 26, between which a connector 24 of a spherical shape is fittedly interposed.

Figure 6:
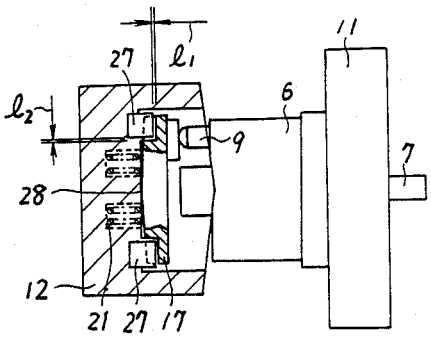
FIG. 6 is a front elevation view partly in section illustrating a third embodiment of a cam plate type axial piston pump according to the present invention.
Figure 7:
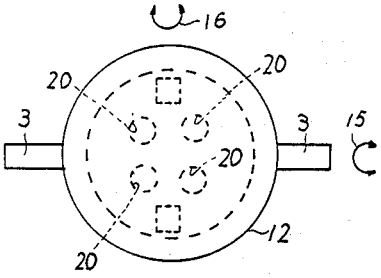
FIG. 7 is a side elevation view showing a cam plate incorporated in the embodiment of FIG. 6.
Figure 8:
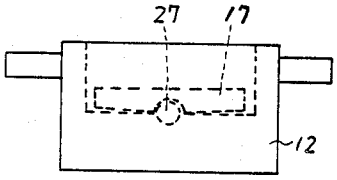
FIG. 8 is a plan view of the cam plate shown in FIG. 7.

A third embodiment of the present invention shown in FIGS. 6 to 8 is so constructed that a thrust plate 17 is formed on a side surface 28 thereof opposite to a cam plate 12 into a substantially convex shape.

The third embodiment also includes rotation stop members 27 which are fittedly arranged between the cam plate 12 and the thrust plate 17 to prevent rotation of the plate 17 with respect to the cam plate 12 about an input shaft 7. The rotation stop members 27 are arranged so as to define a gap $l_1$ in an axial direction of the thrust plate 17 and a gap $l_2$ in a radial direction thereof between each of the rotation stop members 27 and the thrust plate 17. Thus, the rotation stop members 27 prevent the thrust plate 17 from rotating with respect to the cam plate 12 about the input shaft 7 and permit it to be pivotally moved in any direction with respect to the cam plate 12 within a range of each of the gaps $l_1$ and $l_2$.

As described above, the third embodiment is so constructed that the rotation stop members 27 prevent rotation of the thrust plate 17. Accordingly, it may permit springs 21 to be arranged so as to act directly on the thrust plate 17 through no means such as the forcing pistons 23 in the first and second embodiments described above.

Figure 9:
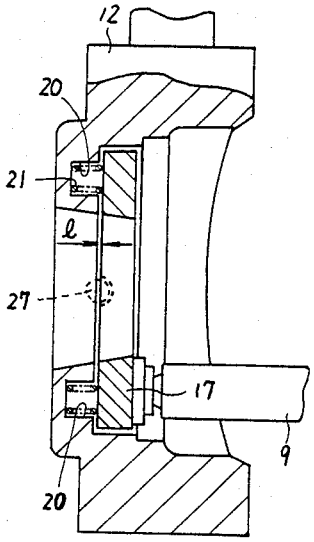
FIG. 9 is a front elevation view partly in section showing a cam plate used in a fourth embodiment of a cam plate type axial piston pump according to the present invention.
Figure 10:
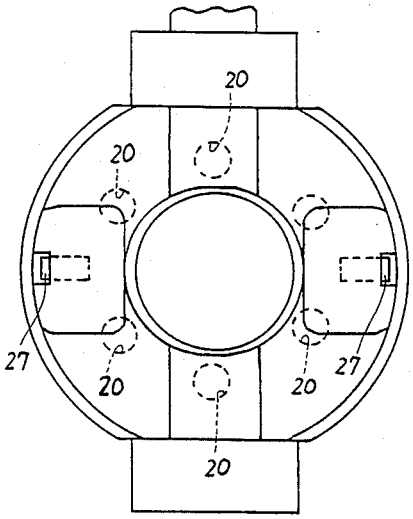
FIG. 10 is a side elevation view of the cam plate shown in FIG. 9.
Figure 11:
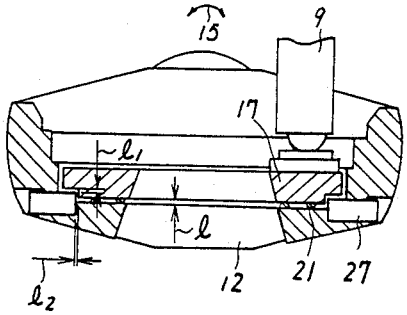
FIG. 11 is a partial sectional view of the cam plate shown in FIG. 9 which is shifted in phase by 90 degrees from a position of FIG. 9.

FIGS. 9 to 11 show a fourth embodiment of a cam plate type axial piston pump according to the present invention. A pump of the fourth embodiment includes rotation stop members 27 for preventing rotation of a thrust plate 17 about an input shaft (not shown) as in the third embodiment. In the fourth embodiment, a surface of the thrust plate 17 opposite to a cam plate 12 is formed to be flat and a plurality of springs 21 are arranged so as to act on the flat surface of the thrust plate 17.

To the thrust plate 17 on which the springs 21 act is also applied pressing force from a piston 9. However, the embodiment is constructed in such a manner that elastic force of the springs 21 and pressing force of the piston 9 are balanced with each other near a neutral point of the thrust plate 17, so that a gap may be kept between the cam plate 12 and the thrust plate 17. This results in the thrust plate 17 being held at a floating state near the neutral point, so that it may be pivotally moved in any direction within a range of the gap l.

Thus, when a control lever is moved from a position near its neutral point to load the pump, pressing force of the piston 9 causes the thrust plate 17 to be pressed against the cam plate 12, resulting in the pump exhibiting its function.

In the fourth embodiment, it is required to determine elastic force of the springs 21 based on working pressure near the neutral point. Adjustment of the springs 21 may be carried out using means such as the adjustment screws 22 in the first embodiment.

The number of the springs 21 employed likewise may be determined depending on various conditions such as working pressure and the like and is not subjected to any limitation. Any metal spring such as a coiled spring, a belleville spring or the like may be suitably used as each of the springs 21. Alternatively, any other member formed of an elastic material, for example, such as rubber, synthetic resin or the like may be used as the spring 21.

Figure 12:
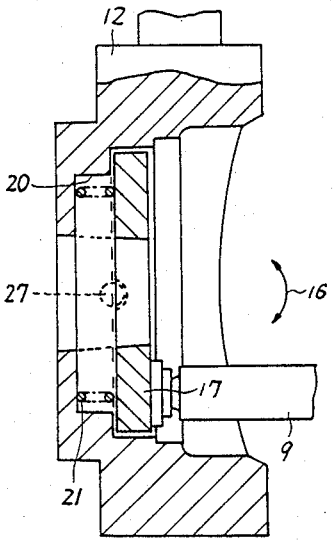
FIG. 12 is a front elevation view partly in section showing a cam plate used in a fifth embodiment of a cam plate type axial piston pump according to the present invention.
Figure 13:
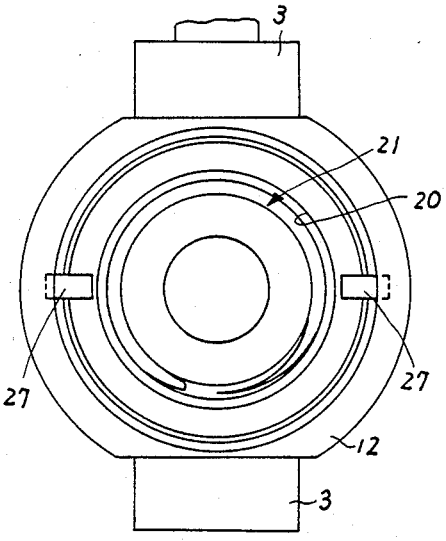
FIG. 13 is a side elevation view of the cam plate shown in FIG. 12.

FIGS. 12 and 13 show a fifth embodiment of a cam plate type axial piston pump according to the present invention. In a piston pump of the fifth embodiment, a cam plate 12 is formed at a central portion of a surface thereof opposite to a thrust plate 17 with a circular recess 20, through which a spring 21 is arranged. The remaining of the fifth embodiment may be constructed in substantially the same manner as the fourth embodiment.

Figure 14:
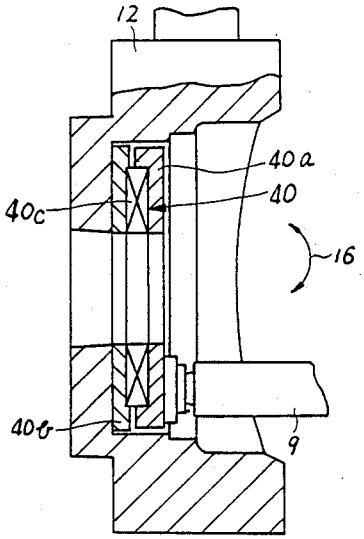
FIG. 14 is a front elevation view partly in section showing a cam plate used in a sixth embodiment of a cam plate type axial piston pump according to the present invention.

A sixth embodiment of the present invention is illustrated in FIG. 14. In a cam plate type axial piston pump of the sixth embodiment, a thrust plate 40 is divided into an upper thrust plate member **40*a* and a lower thrust plate member 40*b*, between which an elastic member 40*c* formed of rubber or the like is interposed. The upper thrust plate member 40*a* deflects the elastic member 40*c* to cause the thrust plate 40 to be inclined in any direction with respect to a cam plate 12. The elastic member 40*c*** may comprise a metal spring or the like.

Figure 15:
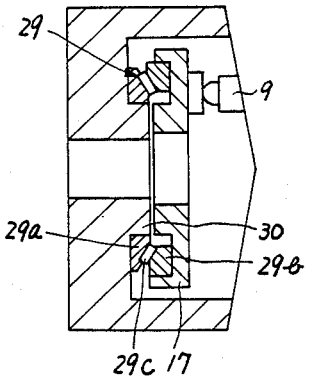
FIG. 15 is a front elevation view partly in section showing a cam plate used in a seventh embodiment of a cam plate type axial piston pump according to the present invention.
Figure 16:
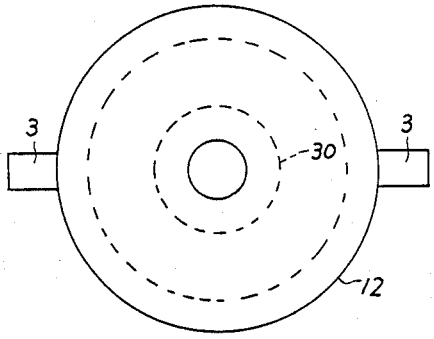
FIG. 16 is a side elevation view of the cam plate shown in FIG. 15.

FIGS. 15 and 16 show a seventh embodiment of a cam plate type axial piston pump according to the present invention. In a piston pump of the embodiment, a cam plate 12 is formed at a central portion of a surface thereof opposite to a thrust plate 17 with an annular projection 30, on which an inner ring **29*a* of a self-aligning roller bearing 29 is fitted. An outer ring of the roller bearing 29*b* is fitted in the thrust plate 17. Between the inner ring 29*a* and the outer ring 29*b* is interposed a spherical roller 29*c*. Such construction causes the thrust plate 17 to be pivotally moved in any direction with respect to the cam plate 12**.

Figure 17:
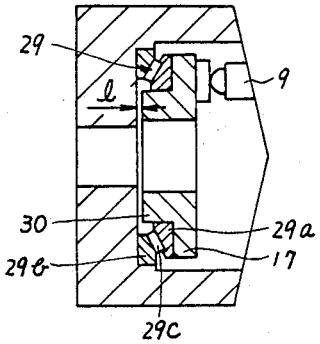
FIG. 17 is a front elevation view partly in section showing a cam plate used in an eighth embodiment of a cam plate type axial piston pump according to the present invention.
Figure 18:
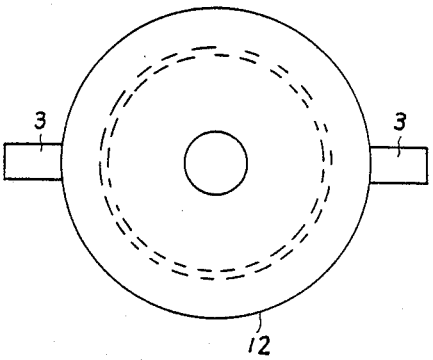
FIG. 18 is a side elevation view of the cam plate shown in FIG. 17.

An eighth embodiment of a cam plate type axial piston pump according to the present invention is shown in FIGS. 17 and 18, wherein a thrust plate 17 is formed at a central portion of a surface thereof opposite to a cam plate with an annular projection 30. An inner ring **29*a* and an outer ring 29*b* of a self-aligning roller bearing 29 are fitted in the thrust plate 17** and cam plate in a manner to be substantially opposite to each other, respectively. The remaining of the embodiment may be constructed in substantially the same manner as the seventh embodiment.

Figure 19:
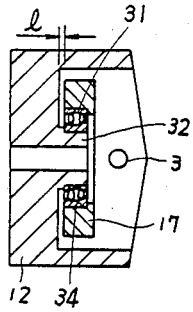
FIG. 19 is a front elevation view partly in section showing a cam plate used in a ninth embodiment of a cam plate type axial piston pump according to the present invention.
Figure 20:
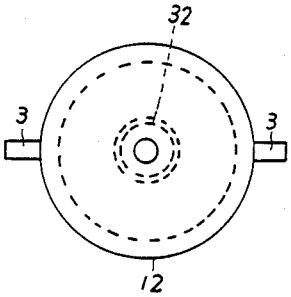
FIG. 20 is a side elevation view of the cam plate shown in FIG. 19.

A ninth embodiment of the present invention is shown in FIGS. 19 and 20, wherein a cam plate 12 is formed at a central portion thereof opposite to a thrust plate 17 with an annular projection 32, on which a self-aligning roller bearing 31 is fitted. The thrust plate 17 is formed on an inner peripheral surface thereof with a recess 34 in which the roller bearing 31 is fitted, so that the thrust plate 17 may be pivotally moved in any direction with respect to the cam plate 12.

Figure 21:
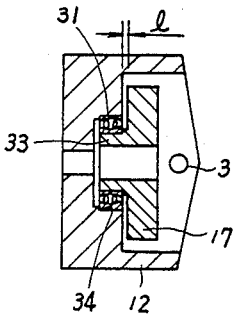
FIG. 21 is a front elevation view partly in section showing a cam plate used in a tenth embodiment of a cam plate type axial piston pump according to the present invention.
Figure 22:
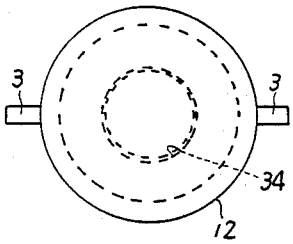
FIG. 22 is a side elevation view of the cam plate shown in FIG. 21.

FIGS. 21 and 22 show a tenth embodiment of a cam plate type axial piston pump according to the present invention. In the embodiment, an annular projection 33 is formed on a thrust plate 17, on which a self-aligning roller bearing 31 is fittedly arranged. Correspondingly, a recess 34 is formed on an inner peripheral surface of a cam plate 12. It will be readily noted that such construction likewise permits the thrust plate 17 to be pivotally moved in any direction with respect to the cam plate 12.

In each of the seventh to tenth embodiments described above, the self-aligning roller bearing is used as a bearing. However, any other bearing such as a ball bearing, a plain bearing or the like may be suitably substituted therefor. Also, means such as the springs 21 in the first embodiment may be provided so as to ensure positioning characteristics of the thrust plate 17.

Figure 25:
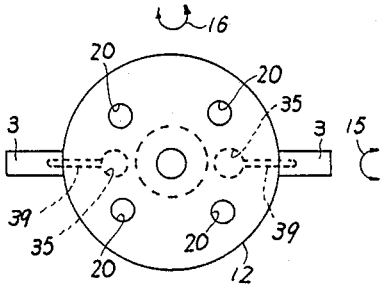
FIG. 25 is a side elevation view showing a cam plate incorporated in the piston pump shown in FIG. 23.
Figure 23:
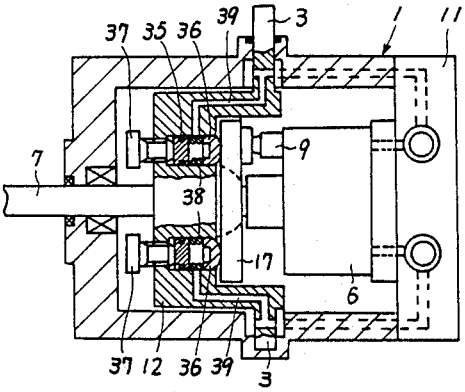
FIG. 23 is a vertical sectional view showing an eleventh embodiment of a cam plate type axial piston pump according to the present invention.
Figure 24:
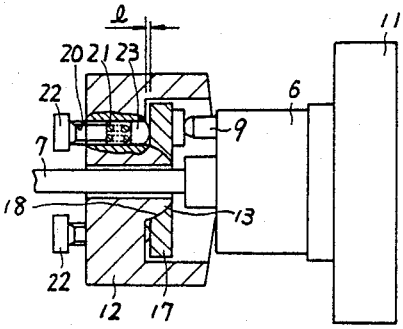
FIG. 24 is a front elevation view partly in section of the piston pump shown in FIG. 23.

FIGS. 23 to 25 show an eleventh embodiment of a cam plate type axial piston pump according to the present invention. A piston pump of the embodiment includes a mechanism for cancelling thrust of a piston 9 of a cylinder block 6 in addition to the structure of the first embodiment described above, to thereby ensure positioning characteristics of a thrust plate 17 and decrease sliding contact between a cam plate 12 and the thrust plate 17 to further facilitate pivotal movement of the thrust plate 17 with respect to the cam plate 12.

More particularly, the cam plate 12 is formed at both lateral portions thereof symmetric with each other about an axis thereof with a pair of holes 35, in which compensating pistons 36 are arranged. Also, the embodiment includes springs 38 which act on the compensating pistons 36 and of which elastic force is adjusted by adjustment screws 37. Further, the embodiment is constructed so as to cause the compensating pistons 36 to be subjected to pressure of fluid acting on the piston 9 of the cylinder block 6 via a passage 39 formed through a port block 11, a housing 1 and the cam plate 12. In addition, in the embodiment, the compensating pistons 36 have a total effective pressure-receiving area equal to a total pressure-receiving area of the piston 9 of the cylinder block 6.

In the eleventh embodiment constructed as described above, discharge pressure or suction pressure acting on the piston 9 of the cylinder block 6 depending on a rotational position of the cylinder block 6 also acts on the compensating pistons 36 arranged on both sides of the cam plate 12. This results in thrust of the piston 9 being offset by pressing force of the compensating pistons 36, to thereby ensure positioning characteristics of the thrust plate 17 or that the plate 17 is kept at a fixed position with respect to the plate 12 and decrease sliding contact between the cam plate 12 and the thrust plate 17.

The number of and manner of construction of the compensating pistons 36 acting pressing force on the thrust plate 17 are not subjected to any specific limitation so long as they can cancel thrust of the piston 9 of the cylinder block 6.

Figure 26:
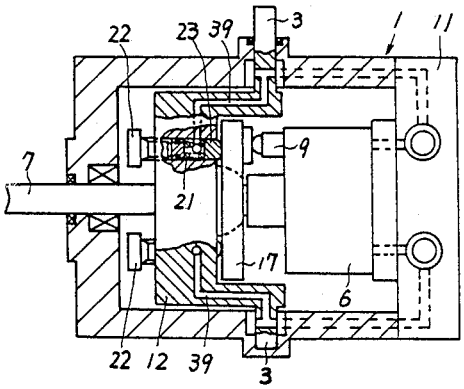
FIG. 26 is a vertical sectional view showing an twelfth embodiment of a cam plate type axial piston pump according to the present invention.
Figure 27:
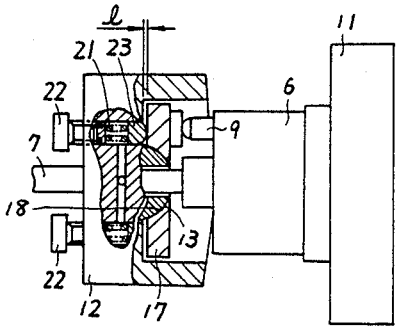
FIG. 27 is a front elevation view partly in section of the piston pump shown in FIG. 26.
Figure 28:
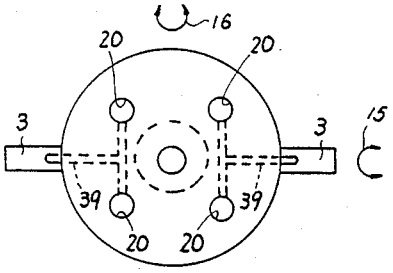
FIG. 28 is a side elevation view showing a cam plate incorporated in the piston pump shown in FIG. 26.

A twelfth embodiment of the present invention is shown in FIGS. 26 to 28. The embodiment is constructed so as to cause fluid pressure acting on a piston 9 of a cylinder block 6 to act on forcing pistons 23 symmetrically arranged on a cam plate 12. The forcing pistons 23 also carry out the same action as the compensating pistons 36 in the eleventh embodiment described above.

In each of the eleventh and twelfth embodiments described above, pressure acting on the piston 9 of the cylinder block 6 is caused to act on the compensating pistons 36 or forcing pistons 23 in order to cancel thrust of the piston 9. However, it may be constructed so as to decrease an effective pressure-receiving area of the compensating pistons 36 or forcing pistons 23 and increase force of the spring 38 or 21 to cause the elastic force to be offset with a part of the thrust of the piston 9.

The construction employed in each of the eleventh and twelfth embodiments for cancelling thrust of the piston 9 fitted in the cylinder block 6 may be applied to the second to tenth embodiments described above as well as the first embodiment.

Also, the cam plate 12 in each of the embodiments described above is of the trunnion type that both ends each act as a bearing. However, it is not limited to such a specific type. For example, it may be so constructed that a rear portion thereof acts as a bearing.

As can be seen from the foregoing, in each of the second to twelfth embodiments described above, the thrust plate 17 satisfactorily exhibits self-return moment and a neutral width because it is pivotally moved in any direction with respect to the cam plate 12. Thus, it will be noted that each of the embodiments exhibits good neutral characteristics like the first embodiment.

Figure 29:
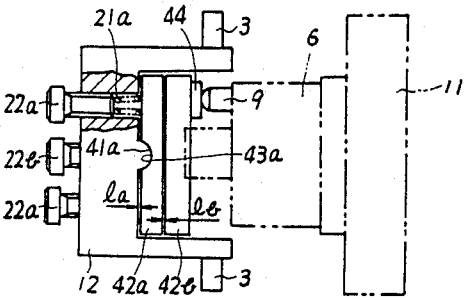
FIG. 29 is a partly cutaway front elevation view showing a cam plate used in a thirteenth embodiment of a cam plate type axial piston pump according to the present invention.
Figure 30:
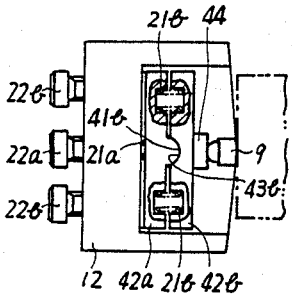
FIG. 30 is a partly cutaway front elevation view of the cam plate shown in FIG. 29 which is shifted in phase by 90 degrees from a position of FIG. 29.

FIGS. 29 and 30 show a thirteenth embodiment of a cam plate type axial piston pump according to the present invention, wherein a cam plate 12 is provided thereon with an elongated projection 41*a* of a semi-circular shape in section which extends in a direction perpendicular to an axial direction of the trunnion pins 3. The embodiment also includes a lower thrust plate member 42*a* arranged opposite to the cam plate 12, which is formed on one surface thereof opposite to the plate 12 with a recess 43*a* corresponding to the elongated projection 41*a* so as to receive it therein. The lower thrust plate member 42*a* is also formed on the other surface thereof with an elongated projection 41*b* substantially extending parallel to the axial direction of the trunnion pins 3.

On the lower thrust plate member 42*a* is superposed an upper thrust plate member 42*b*, which is formed on a surface thereof opposite to the other surface of the lower thrust plate member 42*a* with a recess 43*b* in which the projection 41*b* of the lower thrust plate member 42*a* is fitted.

Also, the thirteenth embodiment is so constructed that when the lower and upper thrust plate members 42*a* and 42*b* are kept horizontal while the cam plate 12 and lower plate member 42*a* are fitted together and the lower plate member 42*a* and upper plate member 42*b* are fitted together, gaps $l_a$ and $l_b$ are defined between the cam plate 12 and the lower thrust, plate member 42*a* and between the lower thrust plate member 42*a* and the upper thrust plate member 42*b*, respectively, resulting in the lower and upper thrust plate members 42*a* and 42*b* being pivotally moved within a range of the gaps $l_a$ and $l_b$. The projections 41*a* and 41*b* are arranged so as to be perpendicular to each other, and the lower thrust plate member 42*a* and upper thrust plate member 42*b* are pivotally moved in directions indicated at arrows 16 and 15, respectively. Accordingly, the upper thrust plate member 42*b* can be pivotally moved in all directions with the assistance of the lower thrust plate member 42*a*.

In the embodiment, a cylinder block 6 has a piston 9 slidably mounted thereon. The piston 9 is provided on a head portion thereof with a shoe 44, which is slidingly contacted on a surface thereof by the upper thrust plate member 42*b*. Accordingly, the contact surface of the shoe 44 may be pivotally moved in all directions.

The upper and lower thrust plate members 42*a* and 42*b* can be pivotally moved within a range of the gaps $l_a$ and $l_b$. In order to cause both plate members 42*a* and 42*b* to exhibit satisfactory positioning characteristics, the embodiment is constructed so as to cause forces of springs 21*a* and 21*b* to be exerted between the cam plate 12 and the lower plate member 42*a* and between the lower plate member 42*a* and the upper plate member 42*b*, respectively. However, when it is not required to cause the plate members 42*a* and 42*b* to exhibit such positioning characteristics, the springs 21*a* and 21*b* may be eliminated. Elastic forces of the springs 21*a* and 21*b* may be adjusted by means of adjustment screws 22*a* and 22*b*, respectively.

As described above, the lower thrust plate member 42*a* is pivotally moved in the lateral direction of the cam plate and pivotal movement of the upper plate member 42*b* is carried out in the inclination direction of the cam plate. However, the embodiment may be so constructed that both plate members may be moved in directions contrary to those described above.

Also, in the thirteenth embodiment, the projection 41*a* and recess 43*a* are provided at the cam plate and the lower thrust plate member 42*a*, respectively. However, they may be arranged in a manner contrary to the above. In addition, one of the cam plate plate 12 and lower thrust plate member 42*a* may be fixedly provided with a member of a semi-circular shape in section like the elongated projection 41*a* which serves as a connector, and the other is formed with a recess corresponding to the connector. This may be similarly applied to the lower and upper thrust plate members 42*a* and 42*b*.

Thus, in the embodiment, cooperation between both thrust plate members 42*a* and 42*b* pivotally moved in different directions causes the contact surface of the shoe 44 or the surface of the upper thrust plate member 42*b* to be pivotally moved in all directions. Directions of pivotal movement of the plate members are not limited to those perpendicular to each other.

Figure 31:
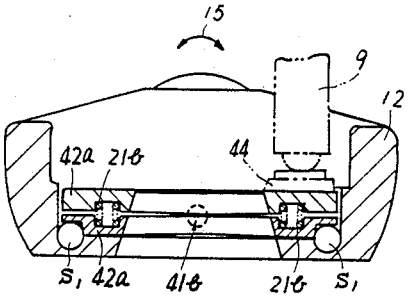
FIG. 31 is a partly cutaway front elevation view showing a cam plate used in a fourteenth embodiment of a cam plate type axial piston pump according to the present invention.
Figure 32:
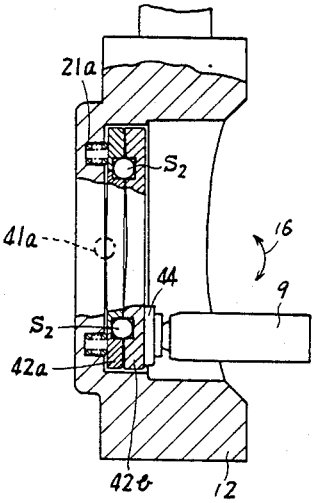
FIG. 32 is a partly cutaway front elevation view of the cam plate shown in FIG. 31 which is shifted in phase by 90 degrees from a position of FIG. 29.

FIGS. 31 and 32 show a fourteenth embodiment of a cam plate type axial piston pump according to the present invention, wherein steel balls $S_1$ and $S_2$ acting as a rotation stop mechanism for preventing rotation of lower and upper thrust plate members 42*a* and 42*b* about an input shaft are arranged in order to ensure pivotal movement of both lower and upper thrust plate members 42*a* and 42*b* about pivotal axes thereof. Such construction of the embodiment merely requires arrangement of an elongated projection on only any one of the cam plate 12 and lower thrust plate member 42*a*. This is also applied to a relationship between the lower thrust plate member 42*a* and the upper thrust plate member 42*b*.

Figure 33:
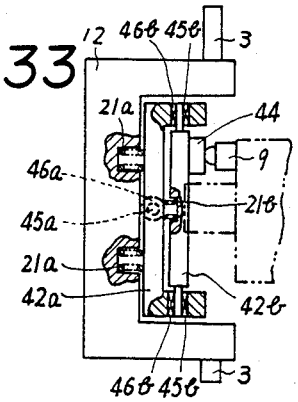
FIG. 33 is a sectional view showing an essential part of a fifteenth embodiment of a cam plate type axial piston pump according to the present invention.

In a fifteenth embodiment of the present invention illustrated in FIG. 33, a lower thrust plate member 42*a* is provided on both sides thereof with trunnion pins 45*a* and correspondingly a cam plate 12 is provided with bearing elements 46*a* which rotatably support the trunnion pins 45*a* therein. Likewise, an upper thrust plate member 42*b* is provided on both sides thereof with trunnion pins 45*b* in a direction perpendicular to an axial direction of the pins 45*a* and correspondingly the lower thrust plate member 42*a* is provided with bearing elements 46*b* which rotatably support the trunnion pins 45*b* therein.

In the so-constructed fifteenth embodiment as well as the fourteenth embodiment described above, cooperation between both thrust plate members 42*a* and 42*b* pivotally moved in different directions causes a slid contact surface of a show 44 or a surface of the upper thrust plate member 42*b* to be pivotally moved in all directions.

Figure 34:
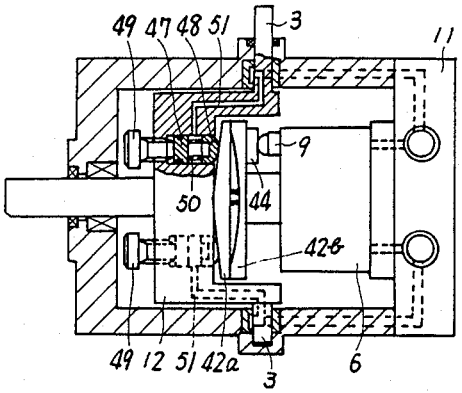
FIG. 34 is a sectional view showing an essential part of a sixteenth embodiment of a cam plate type axial piston pump according to the present invention.

FIG. 34 shows a sixteenth embodiment of a cam plate type axial piston pump according to the present invention. A piston pump of the sixteenth embodiment employs a lower thrust plate member 42*a*, an upper thrust plate member 42*b* and steel balls (not shown) serving as a rotation stop mechanism for preventing rotation of both plate members about an input shaft which may be constructed in substantially the same manner as those in the fourteenth embodiment. The lower thrust plate member 42*a* is adapted to be pivotally moved in a lateral direction of the cam plate 12. The cam plate 12 is formed on both lateral portions thereof with holes 47, in which forcing pistons 48 are arranged. On each of the pistons 48 acts a spring 50 of which elastic force is adjusted by an adjustment screw 49. A piston 9 arranged on a cylinder block 6 is adapted to produce fluid pressure which is applied through a passage 51 to each of the pistons 48. In the sixteenth embodiment, the lower thrust plate member 42*a* is provided on a surface thereof opposite to the cam plate 12 with a projection which exhibit substantially the same function as the projection 41*a* in the thirteenth embodiment.

Thus, in the sixteenth embodiment, pressure is applied to the forcing pistons 48, so that moment in a lateral direction of the lower thrust plate member due to thrust (discharge pressure and suction pressure) of the piston 9 may be balanced. This results in ensuring positional characteristics of the lower thrust plate member 42*a* and decreasing sliding contact between the cam plate 12 and the lower thrust plate member 42*a* and their wear.

The forcing pistons 48 which apply pressure to the lower thrust plate member 42*a* may be constructed in any desired manner so long as it can cancel thrust of the piston 9. For example, the forcing pistons 48 may be provided on the lower thrust plate member 42*a*, so that the plate member may be forced by means of pressure applied from a side of the cam plate 12. Also, the number of the pistons 48 may be suitably determined as desired.

Figure 35:
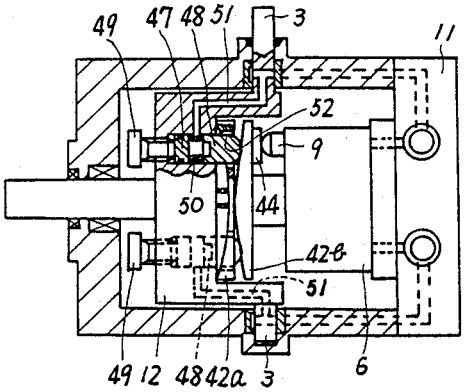
FIG. 35 is a sectional view showing an essential part of a seventeenth embodiment of a cam plate type axial piston pump according to the present invention.

A seventeenth embodiment of the present invention shown in FIG. 35 is constructed in such a manner that a lower thrust plate member 42*a* is provided with holes 52 and forcing pistons 48 are inserted through the holes 52 to exert force of each of the pistons 48 on an upper thrust plate member 42*b* pivotally moved in a lateral direction, to thereby prevent interference with pivotal movement of the lower thrust plate member 42*a*.

In the seventeenth embodiment, it is merely required that pivotal movement of the upper thrust plate member 42*b* on which the forcing pistons 48 act is carried out at least partially in the lateral direction.

Figure 36:
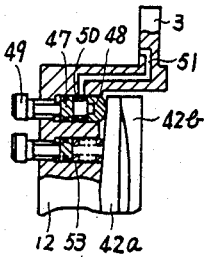
FIG. 36 is a fragmentary sectional view showing an essential part of an eighteenth embodiment of a cam plate type axial piston pump according to the present invention.
Figure 40:
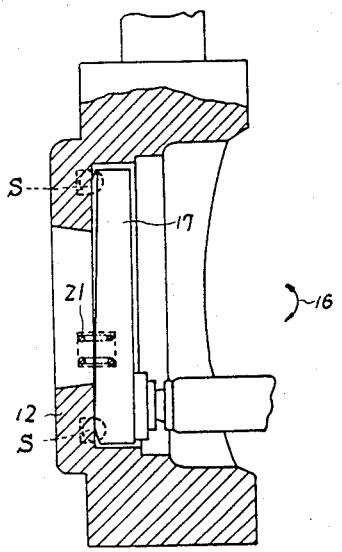
FIG. 40 is a front elevation view partly in section showing a cam plate used in a twentieth embodiment of a cam plate type axial piston pump according to the present invention.
Figure 42:
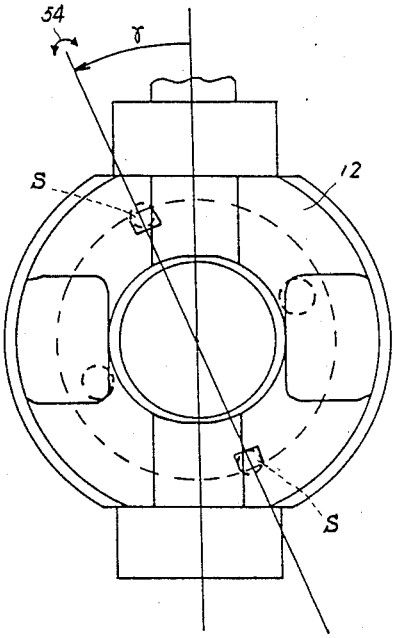
FIG. 42 is a side elevation view of the cam plate shown in FIG. 40.
Figure 41:
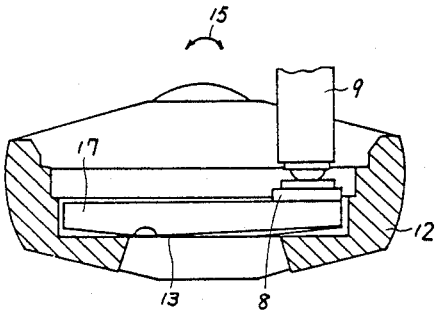
FIG. 41 is a front elevation view partly in section of the cam plate shown in FIG. 40 which is shifted in phase by 90 degrees from a position of FIG. 40.

An eighteenth embodiment of the present invention shown in FIG. 36 is constructed in substantially the same manner as the seventeenth embodiment described above, except that an adjustment spring 53 for ensuring positioning characteristics of a lower thrust plate member 42*a* is provided separate from forcing pistons 48.

As described above, in each of the sixteenth to eighteenth embodiments, the forcing pistons 48 force the lower or upper thrust plate member 42*a* or 42*b*. However, it may be so constructed that an effective area of the forcing pistons is decreased and elastic force of the springs 50 and 53 is increased to bear a part of pressure applied from the piston 9. Also, in each embodiment, the lower and upper thrust plate members 42*a* and 42*b* constitute a thrust plate. However, three or more such thrust plate members may be used therefor. Further, the cam plate is of the trunnion type, however, it is not limited to such a specific type. For example, it may be formed into a semi-circular shape.

Figure 37:
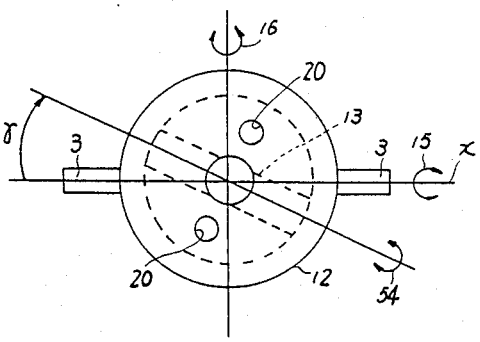
FIG. 37 is a side elevation view showing a cam plate used in a nineteenth embodiment of a cam plate type axial piston pump according to the present invention.
Figure 38:
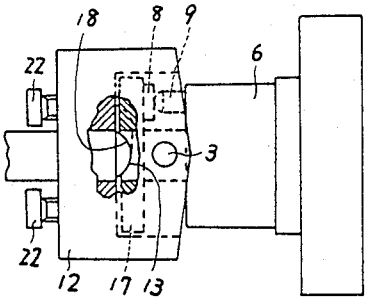
FIG. 38 is a partly cutaway front elevation view of the piston pump shown in FIG. 37.
Figure 39:
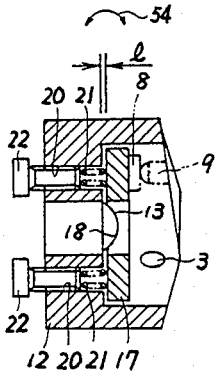
FIG. 39 is a vertical sectional view of the cam plate shown in FIG. 37.

FIGS. 37 to 39 show a nineteenth embodiment of a cam plate type axial piston pump according to the present invention, wherein a cam plate 12 is provided with an elongated projection of a substantially semi-circular shape in section which is arranged to extend through a central portion thereof. The projection 13 is positioned at an angle $\gamma$ with respect to an axis of trunnion pins 3, wherein $\gamma$ is above 0 degree and below 90 degrees ($0<|\gamma|<90°$).

A thrust plate 17 arranged opposite to the cam plate 12 is provided on a surface thereof opposite to the plate 12 with a recess 18 corresponding to the projection 13, which is fitted in the recess 18. The embodiment is constructed so as to define a gap l between the cam plate 12 and the thrust plate 17 when the cam plate 12 and thrust plate 17 are vertically positioned while the projection 13 is fitted in the recess 18, so that the thrust plate 17 may be pivotally moved with a range of the gap l.

Thus, the thrust plate 17 is pivotally moved about the projection 13 in a direction indicated at an arrow 54, which is different from both an inclination direction and a lateral direction of the cam plate 12.

In addition to pivotal movement of the thrust plate 17 pivotally moved in a range of the gap as described above, the embodiment is constructed in a manner to cause elastic force of springs 21 on the surface of the thrust plate 12 to be exerted on the surface thereof opposite to the cam plate 12, to thereby ensure that the thrust plate 17 exhibits good positioning characteristics. The springs 21 are arranged in a plurality of holes provided at the cam plate 12, respectively.

Springs 21 are provided for the purpose of improving positioning characteristics of the thrust plate 17, accordingly, they may be eliminated so long as the thrust plate 17 is pivotally arranged. Elastic force of each of the springs 21 may be adjusted by means of an adjustment screw 22.

In the nineteenth embodiment constructed as described above, the projection 13 and recess 18 are provided at the cam plate 12 and thrust plate 17, respectively. However, they may be arranged in a manner contrary to the above. Also, one of the cam plate 12 and thrust plate 17 may be provided with a member or connector of a shape like the projection 13 in a fixed manner and the other may be formed with a recess corresponding to the connector. Thus, the embodiment may be constructed in any desired manner so long as the thrust plate 17 may be pivotally moved within a range of $0° < |\gamma| < 90°$ which is between the inclination direction of the cam plate and its lateral direction.

A cylinder block 6 is provided with a piston 9 in a slidable manner and the piston is provided on a head portion thereof with a shoe 8 which is slidingly contacts the thrust plate 17.

The surfaces of the projection 13 and recess 18 contacted with each other each are formed into a semi-circular shape. However, they may be formed into any other suitable shape such as a mountain-like shape or the like. Also, when a rotation stop mechanism for preventing rotation of the thrust plate about an input shaft is provided so as not to prevent pivotal movement of the thrust plate 17, the projection may be provided at any one of the thrust plate and cam plate. In such a case, the projection must be provided at an angle of $\gamma$ with respect to the trunnion pins.

A twentieth embodiment of the present invention shown in FIGS. 40 to 43 is so constructed that a surface of a thrust plate 17 opposite to a cam plate 12 is constituted by two planes protruding from ends thereof toward a central portion thereof, and an elongated projection 13 is formed at an intersection between the two planes. The projection 13 may be provided on the cam plate 12. Also, the embodiment includes steel balls S which constitute a rotation stop mechanism for preventing rotation of the thrust plate 17 about an input shaft. The steel balls S each are fitted in recesses formed at both cam plate 12 and thrust plate 17 so as to be opposite to each other.

Figure 44:
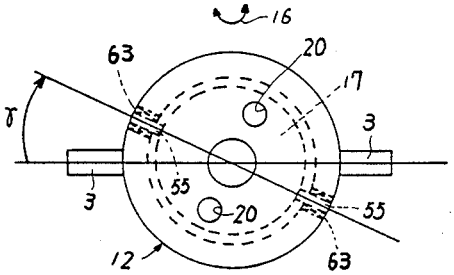
FIGS. 44 and 45 are a side elevation view and a front elevation view showing a cam plate used in a twenty-first embodiment of a cam plate type axial piston pump according to the present invention, respectively.
Figure 43:
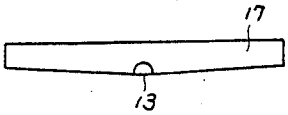
FIG. 43 is a side elevation view showing a thrust plate used in the twentieth embodiment of FIG. 40.
Figure 45:
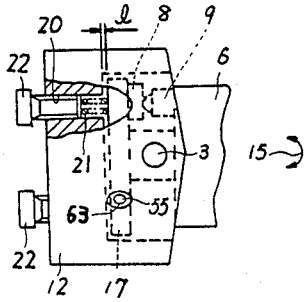

FIGS. 44 and 45 show a twenty-first embodiment of a cam plate type axial piston pump according to the present invention, wherein a gap l is defined between a cam plate 12 and a thrust plate 17 and the thrust plate 17 is provided on both sides thereof with trunnion pins 5. The trunnion pins 55 are supported in bearings 63 of the cam plate 12 to pivotally move the thrust plate 17 in any direction between an inclination direction of the cam plate 12 and its lateral direction.

Figure 46:
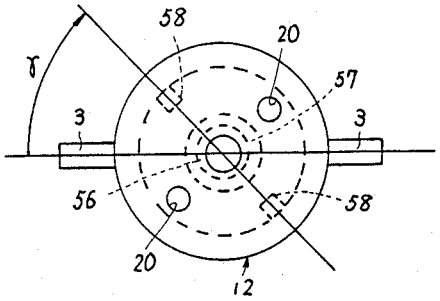
FIGS. 46 and 47 are a side elevation view and a front elevation view showing a cam plate used in a twenty-second embodiment of a cam plate type axial piston pump according to the present invention, respectively.
Figure 47:
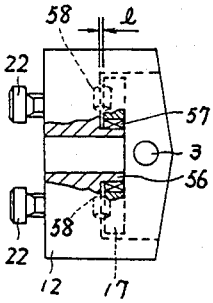

A twenty-second embodiment of the present invention shown in FIGS. 46 and 47 is so constructed that a cam plate 12 is formed at a central portion thereof with a projection 56, on which a self-aligning roller bearing 57 is fitted. The roller bearing 57 serves to support a thrust plate 17 in a manner to be pivotally moved within a range of an angle $\gamma$ with respect to an axis of trunnion pins 3 of the cam plate 12. Also, around an axis about which the thrust plate 17 is pivotally moved is arranged a rotation stop mechanism 58 for preventing rotation of the thrust plate 17 about an input shaft. The remaining of the embodiment may be constructed in substantially the same manner as the nineteenth embodiment described above. In the illustrated embodiment, the cam plate 12 is provided with the projection 56. However, it may be provided at the thrust plate 17.

Figure 49:
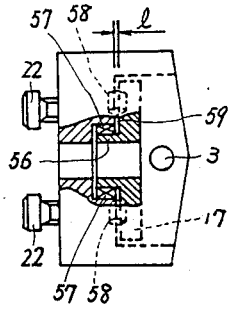
FIGS. 48 and 49 are a side elevation view and a front elevation view showing a cam plate used in a twenty-third embodiment of a cam plate type axial piston pump according to the present invention, respectively.
Figure 48:
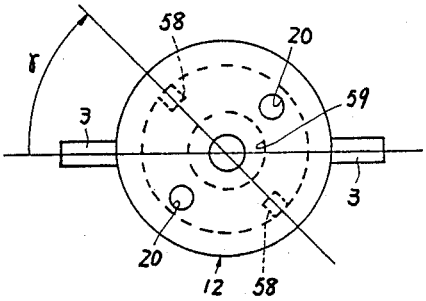

FIGS. 48 and 49 show a twenty-third embodiment of the present invention, wherein a thrust plate 17 is formed with a projection 56, on which a self-aligning roller bearing 57 is fitted, and correspondingly a cam plate 12 is formed with a recess 59 in which the roller bearing 57 is received. The remaining of the embodiment may be constructed in substantially the same manner as the twenty-second embodiment described above.

Figure 50:
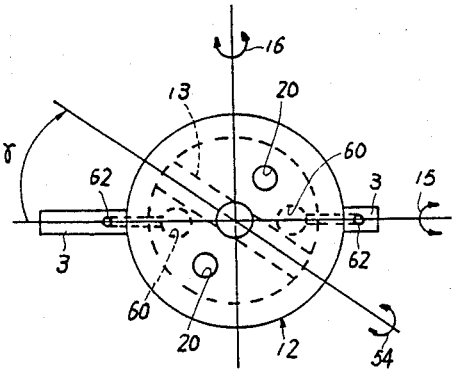
FIGS. 50 and 51 are a side elevation view and a vertical sectional view showing a cam plate used in a twenty-fourth embodiment of a cam plate type axial piston pump according to the present invention, respectively.
Figure 51:
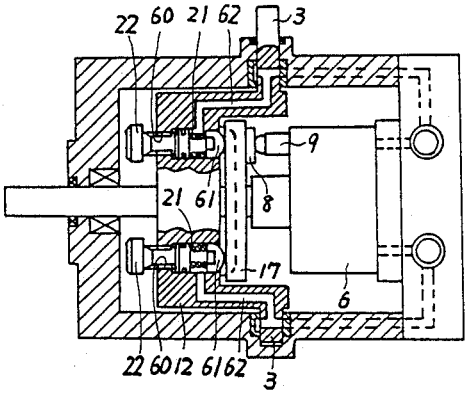

A twenty-fourth embodiment of the present invention shown in FIGS. 50 and 51 includes a mechanism for cancelling hydraulic thrust of a piston 9 mounted on a cylinder block in addition to the structure of the nineteenth embodiment described above.

More particularly, a cam plate 12 is at lateral positions thereof symmetric with each other with holes 60, in which forcing pistons 61 are arranged. On each of the forcing pistons 61 acts a spring 21 of which elastic force is adjusted by an adjustment screw 22. Also, on the forcing pistons 61 is exerted fluid pressure (discharge pressure or suction pressure) of the piston 9 of the cylinder block 6 through a passage 62.

In the twenty-fourth embodiment constructed as described above, discharge pressure and suction pressure of the piston 9 are applied to each of the forcing pistons 61, so that moment in a lateral direction of the cam plate due to hydraulic thrust of the piston 9 may be balanced. Also, force of the pistons 61 causes sliding contact between the cam plate 12 and the thrust plate 17 to be decreased.

The forcing pistons 61 which exert force on the thrust plate 17 may be constructed in any desired manner so long as it may cancel hydraulic thrust of the piston 9. Also, the number of the pistons 61 may be suitably determined as desired.

As described above, in the embodiment, the forcing pistons 61 cancel hydraulic thrust of the piston of the cylinder block 6. However, a part of the hydraulic thrust may be born by decreasing an effective are of the forcing pistons 61 and increasing elastic force of the springs 21. It is a matter of course that the mechanism for cancelling hydraulic thrust of the piston 9 in the twenty-fourth embodiment may be applied to each of the twentieth to twenty-third embodiments.

In each of the nineteenth to twenty-fourth embodiments, the cam plate is of the trunnion type. However, it may be formed into any other suitable shape such as a semi-circular shape or the like. Also, the thrust plate is pivotally moved about the axis inclined within a small angle range more than 0° and less than 90° with respect to the trunnion pins. At this time, when the axis of pivotal movement of the thrust plate more approaches to 0°, a neutral width of the pump which indicates a range of non-discharge of the pump is increased. However, this tends to decrease a self-return force of the pump. On the contrary, when it approaches to 90°, the neutral width is apt to be decreased although the self-return force is increased.

Accordingly, determination of angle of pivotal axis of the thrust plate depending on characteristics of the pump causes it to exhibit large self-return force while maintaining its sufficient neutral width.

While preferred embodiments of the invention have been described with a certain degree of particularity with reference to the drawings, obvious modifications and variations are possible in the light of the above teachings. It is therefore to be understood that the invention may be practiced otherwise than as specifically described.

What is claimed is:

1. A cam plate type axial piston pump, comprising: a camp plate of which an inclination angle is controlled to control discharge of said pump;

at least one thrust plate arranged opposite to said cam plate; and a piston having a shoe provided at a tip end thereof;

said thrust plate contacting said shoe of said piston;

said thrust plate being arranged opposite to said cam plate being pivotally movable in any direction with respect to said cam plate.

2. The combination of claim 1, additionally comprising a pair of trunnion pins mounted opposite one another upon said cam plate and extending outwardly therefrom, wherein said thrust plate is arranged on said cam plate, and said thrust plate being pivotally movable about an axis inclined within a range above 0 degree and below 90 degree with respect to an axis of the trunnion pins.

3. The combination of claim 1, further comprising at least one other thrust plate movable in any direction, said thrust plate being arranged between said cam plate and said shoe so as to be pivotally movable in directions different from one another, a sliding surface of said shoe being pivotally movable in all directions with respect to said cam plate.

4. The combination of claim 1, wherein said pump is a cam plate type axial pump of a rotational cylinder block type and said cam plate is provided with means for pivotally supporting said cam plate on said pump, wherein said thrust plate is arranged on said cam plate, and said thrust plate is pivotally movable about an axis inclined within a range above 0° and below 90° with respect to a pivotal axis of said cam plate.

5. The combination of claim 1, wherein said cam plate is formed at a central portion of an inner surface thereof, with one of a projection having a substantially semi-spherical shape and a complementary recess to said projection, said thrust plate is provided at a central portion of a surface thereof opposite said cam plate with the other of said projection and recess, together at said cam plate and thrust plate being fitted said projection and recess to be concentric with one another and to define a discrete gap therebetween in an axial direction of said cam plate.

6. The combination of claim 5, additionally comprising a plurality of through-holes axially formed in said cam plate, a plurality of pistons and springs, each spring and piston arranged in a respective through-hole and acting upon said thrust plate.

7. The combination of claim 5, additionally comprising a cylinder block upon which said piston is mounted to contact said thrust plate, said cam plate comprising a through-hole extending substantially along a central axis thereof, and an input shaft mounted upon said cylinder block to forwardly extend therefrom and project through said through-hole in said cam plate.

8. The combination of claim 1 wherein said cam plate and thrust plate are formed at portions opposite one another with recesses defining an opening for interposing of a connector of a circular spherical shape to define a discrete gap between said cam and thrust plates when interposed therein.

9. The combination of claim 1, wherein said thrust plate is formed on a side surface facing said cam plate into a substantially convex shape, and additionally comprising at least one stop member fitted between said cam plate and thrust plate to define a first gap between the same and said thrust plate in an axial direction of said cam plate and a second gap between the same and said thrust plate in a radial direction of said cam plate.

10. The combination of claim 1, wherein said thrust plate comprises a flat surface facing said cam plate, and additionally comprising a plurality of springs arranged to act on said flat surface of said thrust plate to balance pressing force of said piston on said thrust plate to maintain a gap between said cam plate and said thrust plate.

11. The combination of claim 1, wherein said cam plate is formed at a central portion of a surface thereof opposite said thrust plate with a circular recess, and additionally comprising a spring arranged in said circular recess.

12. The combination of claim 1, additionally comprising a plurality of thrust plates, and an elastic member arranged therebetween 13. The combination of claim 1, wherein said cam plate comprises an annular projection formed on a central portion of a side thereof facing said thrust plate, and additionally comprising an inner, self-aligning roller bearing ring fitted on said annular projection, an outer self-aligning roller bearing ring fitted on said thrust plate, and a spherical or circular roller interposed between said inner and outer bearing rings.

14. The combination of claim 1, wherein said thrust plate comprises an annular projection formed on a central portion of a side thereof facing said cam plate, and additionally comprising an outer self-aligning roller bearing ring fitted on said annular projection, an inner self-aligning roller bearing ring fitted on said cam plate, and a spherical or circular roller interposed between said inner and outer bearing rings.

15. The combination of claim 1, wherein said cam plate is formed at a central portion thereof opposite said thrust plate with an annular projection, said thrust plate is formed on an inner peripheral surface thereof with a recess, and additionally comprising a roller bearing fitted on said projection and in said recess.

16. The combination of claim 1, wherein said cam plate, is formed at a central portion thereof opposite said thrust plate with a recess, said thrust plate is formed on an inner peripheral surface thereof with an annular projection, and additionally comprising a roller bearing fitted on said projection and in said recess.

17. The combination of claim 1, additionally comprising means for cancelling thrust of said piston, comprising a pair of holes symmetrically formed at lateral portions of said cam plate, a spring and a piston fitted in each said hole, and a passageway communicating with each said hole for introduction of pressure fluid thereinto.

18. The combination of claim 1, additionally comprising an upper thrust plate and a lower thrust plate, with said cam plate being provided on a surface thereof with one of a first semi-circular projection and complementary recess, said lower thrust plate being provided on a surface thereof facing said cam plate with the other of said first projection and recess, said lower thrust plate being provided on a surface facing said upper thrust plate with one of a second semi-circular projection and complementary recess, and said upper thrust plate being formed on a surface thereof facing said lower thrust plate with the other of said second projection and recess, with said first and second projections and complementary recesses defining respective gaps between said cam plate and lower thrust plate, and said lower and upper thrust plates in an axial direction of said cam plate.

19. The combination of claim 1, wherein said thrust plate is divided into separate lower and upper plates and additionally comprising means for preventing rotation of said thrust plates about an input shaft, comprising steel balls situated between said lower plate and cam plate.

20. The combination of claim 1, additionally comprising an upper thrust plate and a lower thrust plate, said lower thrust plate provided with trunnion pins, said cam plate provided with bearing elements for said trunnion pins, said upper thrust plate provided with trunnion pins and said lower thrust plate provided with bearing elements for said trunnion pins of said upper thrust plate.

21. The combination of claim 1, wherein said thrust plate is divided into separate upper and lower thrust plates, and said lower thrust plate is arranged to be pivotally movable in an axial direction of said cam plate.

22. The combination of claim 1, wherein said thrust plate is divided into separate upper and lower plates, and said lower thrust plate comprises holes for passage of pistons therethrough to contact said upper thrust plate, whereby said upper thrust plate can be pivoted in an axial direction of said cam plate.

23. The combination of claim 22, additionally comprising means for adjusting position of said lower thrust plate.

24. The combination of claim 1, additionally comprising a pair of trunnion pins mounted opposite one another upon said cam plate and extending outwardly therefrom, said cam plate being provided at a central portion thereof with one of (i) a projection positioned at an angle between 0°–90° with respect to an axis of said trunnion pins and (ii) a complementary recess, and said thrust plate being provided with the other of said projection (i) and complementary recess (ii).

25. The combination of claim 1, wherein a surface of said thrust plate opposite said cam plate is defined by two intersecting planes forming an elongated projection thereon.

26. The combination of claim 1, wherein said thrust plate is provided with trunnion pins on opposite sides thereof and said cam plate comprises bearings for said trunnion pins, with said thrust plate pivotally mounted with respect to said cam plate.

27. The combination of claim 1, wherein said cam plate comprises a projection at a central portion thereon, and additionally comprising a self-aligning roller bearing mounted on said projection for supporting said thrust plate, and means for preventing rotation of said thrust plate about an input shaft.

28. The combination of claim 1, wherein said thrust plate comprises a projection at a central portion thereon and additionally comprising a self-aligning roller bearing mounted on said projection for supporting said thrust plate, and means for preventing rotation of said thrust plate about an input shaft.

* * * * *